US006205821B1

(12) United States Patent
Sangiacomo

(10) Patent No.: US 6,205,821 B1
(45) Date of Patent: Mar. 27, 2001

(54) SINGLE- OR MULTIPLE-FEED CIRCULAR STOCKING KNITTING MACHINES

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 08/914,408

(22) Filed: Aug. 19, 1997

(30) Foreign Application Priority Data

Jan. 29, 1997 (IT) ..... 97A000009

(51) Int. Cl.[7] ..... D04B 9/00
(52) U.S. Cl. ..... 66/38; 66/8
(58) Field of Search ..... 66/8, 13, 17, 216, 66/217, 222, 224, 57, 223, 225, 226, 227, 38, 40, 78, 116

(56) References Cited

U.S. PATENT DOCUMENTS 4,956,981 * 9/1990 Iida ..... 66/223
5,367,893 * 11/1994 Fucik ..... 66/216
5,577,397 * 11/1996 Iida ..... 66/223

FOREIGN PATENT DOCUMENTS 1180375 9/1987 (IT) .

* cited by examiner

*Primary Examiner*—Danny Worrell
(74) *Attorney, Agent, or Firm*—McGlew & Tuttle, P.C.

(57) ABSTRACT

A circular stocking knitting machine, in which, in addition to the knitting cams, two ascent and descent cams alternating depending on the direction of rotation are provided for the knitting operations with reciprocating motion. Two selection units, which select the needles during a same forward stroke of the cylinder, are additionally provided.

12 Claims, 3 Drawing Sheets

SINGLE- OR MULTIPLE-FEED CIRCULAR STOCKING KNITTING MACHINES

FIELD OF THE INVENTION

The present invention pertains to circular stocking knitting and knitting machines, and specifically pertains to an improvement concerning the means for a working of the knitted parts with reciprocating motion on these machines, as in the manufacture of the heel or of the toe of stockings, socks, and the like.

BACKGROUND OF THE INVENTION

As is well known to persons skilled in the art, the use of devices operated electronically by a computer, which are capable of actuating such parts and/or capable of controlling some functions depending on the rotation and the angular position of the cylinder with needles has already been established in circular stocking knitting machines. These devices are able to reveal, moment by moment, the angular position of the rotating cylinder and therefore of the needles and to manage the signals that derive from them for carrying out a knitting program stored in the electronic computer for a knitting design, either with continuous rotating motion or with reciprocating rotating motion of the cylinder.

Thus, and for example, a previous Italian Patent No. 1180375 of the same applicant describes a multiple-feed circular stocking knitting machine, which comprises a cylinder with needles that is controlled, either with continuous rotating motion or with reciprocating rotating motion, by a motor apparatus controlled by an electronic computer and capable of providing signals for determining the angular position of the cylinder moment by moment, at least one unit for selecting the needles corresponding to the feed stations of the control cams of the vertical movements of the needles selected at each feed station, and in which each feed unit is electronically controlled for selecting needle by needle either in the forward stroke or return stroke of the reciprocating motion of the cylinder and depending on the signals which indicate the angular position of the rotating cylinder. However, in such an embodiment, it is necessary to protect all the feeds with special cams as the needles that are inactive always pass by high, for which reason it is necessary to prevent their interference with other parts.

A circular stocking knitting machine, still operated electronically and having structure for the manufacture of knitted parts with reciprocating motion, as in the heel or in the toe of a stocking, sock or the like, which structure includes the so-called needle-lifter and needle-lowerer pickers, which are arranged and act in such a manner as to reduce the angle of rotation of the cylinder when it moves with reciprocating motion, was then proposed in a subsequent patent of the same applicant.

SUMMARY AND OBJECTS OF THE INVENTION

Starting from such a state of the art which is represented indicatively by the above-mentioned patents, the object of the present invention is to propose an improved circular stocking knitting machine, which makes it possible to work the knitted parts with reciprocating motion in an innovative manner without the presence of the usual pickers, with the possibility of limiting the angle of rotation of the cylinder depending on the number of the needles actually active from time to time during the phases of the increases and decreases in the stroke of the manufacture of a shaped knitting zone.

This is thanks to a preselection of the active needles, which is done either during a stroke (the forward stroke: counter-clockwise direction) of the cylinder, using one of the selection units normally used for the selection of the needles with continuous motion, for which needles are selected for the increases or decreases even before initiating the inverse return stroke (clockwise direction) of the cylinder without the needles having to reach a selection unit beyond the forward stroke as usually occurs.

In addition then, the inactive needles, i.e., those on the middle of the cylinder, which do not participate in the knitting with reciprocating motion, are kept completely lowered so as to eliminate, in the multiple-feed machines, the need for special protection cams in the feed stations, which stations do not participate in the knitting in the course of the operations of the knitted parts with reciprocating motion.

According to the invention, a circular stocking knitting machine is provided comprising a grooved cylinder which is controlled by a motor apparatus. The motor apparatus is electronically operated to rotate with continuous rotating motion and with reciprocating motion, and to provide a signal which indicates the angular position of the cylinder moment by moment. On half of the cylinder there is mounted needles having a long bottom part, and on the other half of the cylinder, the needles have a short bottom part. A lower needle is associated with each of the mounted needles through an intermediate pusher. A fixed shell is provided having a series of cams for controlling the operating movements of the said lower needles. The pushers and the needles, during the rotation of the said cylinder, are provided around the cylinder. At least one thread-feed and knitting-formation station is provided. Selection units are provided acting at least on the lower needles for an operating selection of the needles. In bottom parts of the said needles, a central cam is arranged above and in an intermediate position between two right and left knitting cams. Two right and left lateral cams for ascent and descent on opposite parts of the knitting cams, in a higher position than them and lower than the central cam. A right needle ascent cam and a left needle ascent cam are provided on opposite parts of the knitting cams, lower than them and lower than the lateral cams. At the lower needles, at least one first selection unit with one associated right lower-needle ascent cam and a second selection unit with one associated left lower-needle ascent cam and a said pusher ascent cam are provided. The various cams in the bottom parts of the said needles are intended and/or can be positioned to interact with the needles having a long bottom part. These do participate in the knitting with reciprocating motion, while the needles having a short bottom part are kept inactive following a low course. The first selection unit is arranged, in the direction of counter-clockwise rotation of the cylinder, in front of the feed station in order to select the needles having a long bottom part which during a forward stroke (A) of the cylinder must be inactive and must follow a course (2) of temporary exclusion from activity. The needles having a long bottom part that are not selected follow a course of activity and knitting formation. The second selection unit is arranged within the limits of the feed station in order to carry out, during the same forward stroke and after the formation of the knitting, a preselection of the needles, which follow the course of activity and which must be excluded from activity following the course of temporary exclusion during the said return stroke (R) of the said cylinder. During the forward stroke (A) of the cylinder, the right and left lateral cams act as ascent and descent cams of the needles having a long bottom part, respectively, and define, together with the central cam, the course of momentary inactivity of the needles selected by the first selection unit, while, vice versa, during the return stroke (R) of the said cylinder. The left lateral cam acts as the ascent cam and the right lateral cam acts as the descent cam of the needles having a long bottom part, defining, together with the central cam, the course of momentary inactivity of the needles preselected by the second selection unit.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENTS

Figure 4:
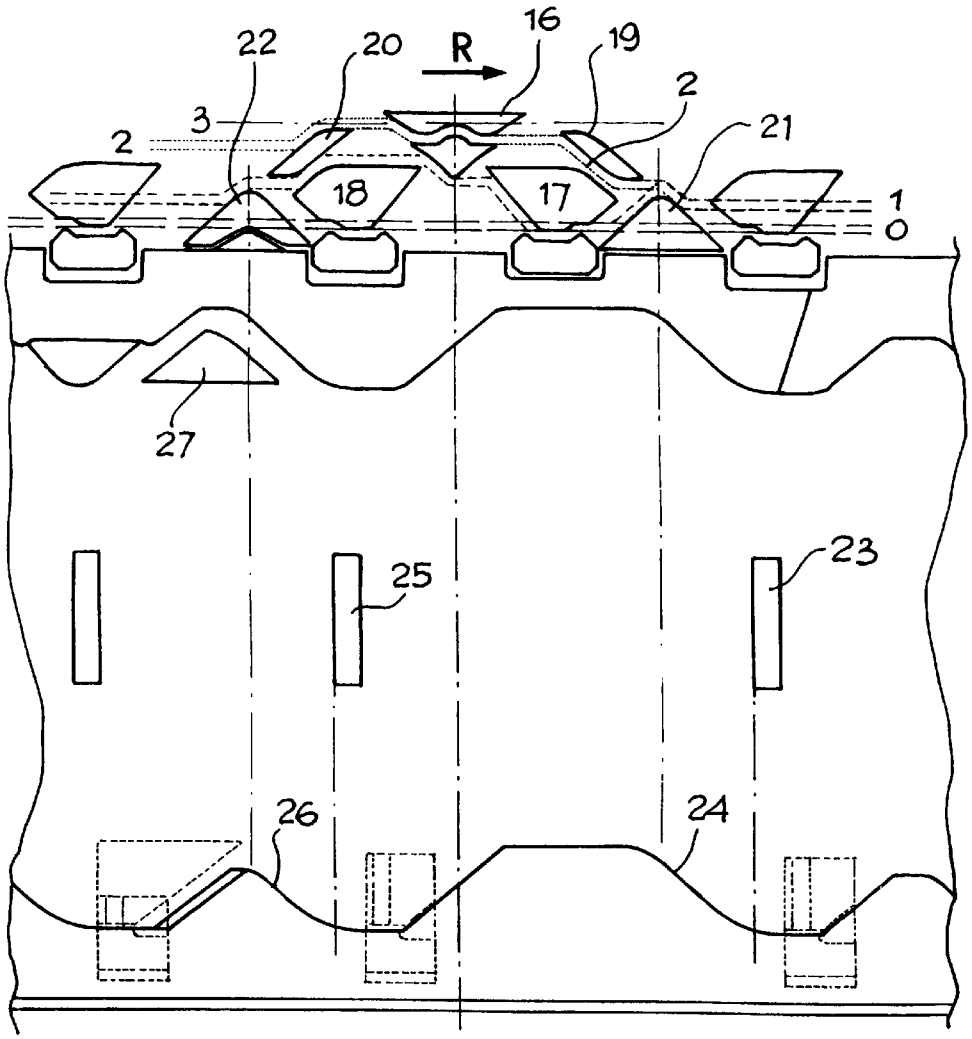
FIG. 4 is a view similar to FIG. 3, but for the return, clockwise, stroke of the cylinder.
Figure 1:
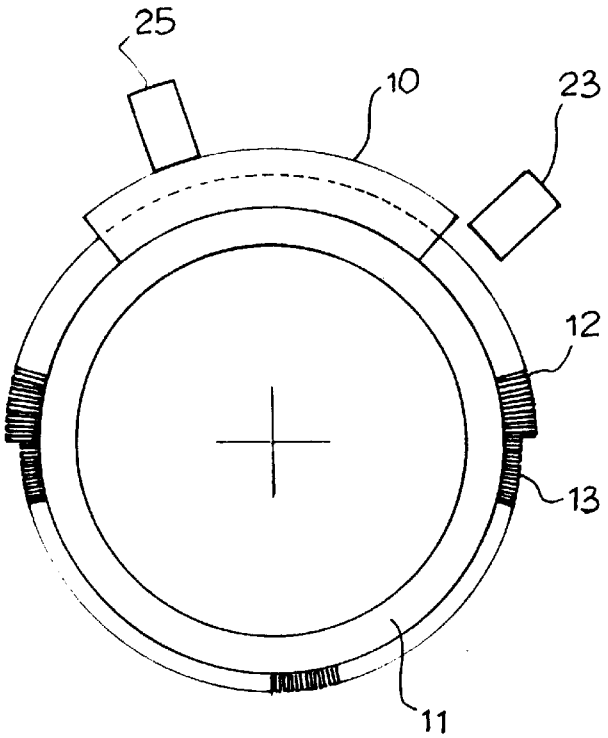
FIG. 1 is a schematic plan view of the cylinder with the arrangement of the needles and of the feed station, or drop, for knitting with reciprocating motion.

The circular stocking knitting machine incorporating the present invention may have multiple feed stations or drops, even though the drawings show only one feed and knitting formation station 10: that used for the manufacture of knitted parts with reciprocating motion, such as the heel and the toe of a stocking or a sock.

At any rate, only the parts of a stocking knitting machine sufficient to understand the present invention are schematically shown in the drawings. The remaining parts, not shown, are known and understood and may be used in the known manner according to the prior art.

Thus, in the drawings, the reference number 11 denotes the cylinder of a circular machine, which cylinder has, on half of its circumference, the needles 12, intended to remain inactive during the knitting with reciprocating motion, and, for the remaining half of the circumference, the needles 13 which, on the other hand, participate in the knitting operations with reciprocating motion. The needles 12 have a short bottom part and are different from the needles 13 which have a longer bottom part.

The cylinder 11 rotates about its own axis, which is controlled by a motor apparatus, either with continuous rotating motion or with reciprocating rotating motion, with a stroke in a direction A (forward stroke; counterclockwise, FIG. 3) followed by a stroke in the opposite direction R (return stroke; clockwise—see FIG. 4).

Lower needles 14 and pushers 15 which interact with the selector units for an operating selection of the needles, which are active from time to time, are associated with the needles 12, 13 on the cylinder. In addition, for the ascent and descent of the lower needles, the pushers and, correspondingly, the needles selected, cams are provided around the cylinder on a shell, which remains closed while the cylinder rotates.

Figure 3:
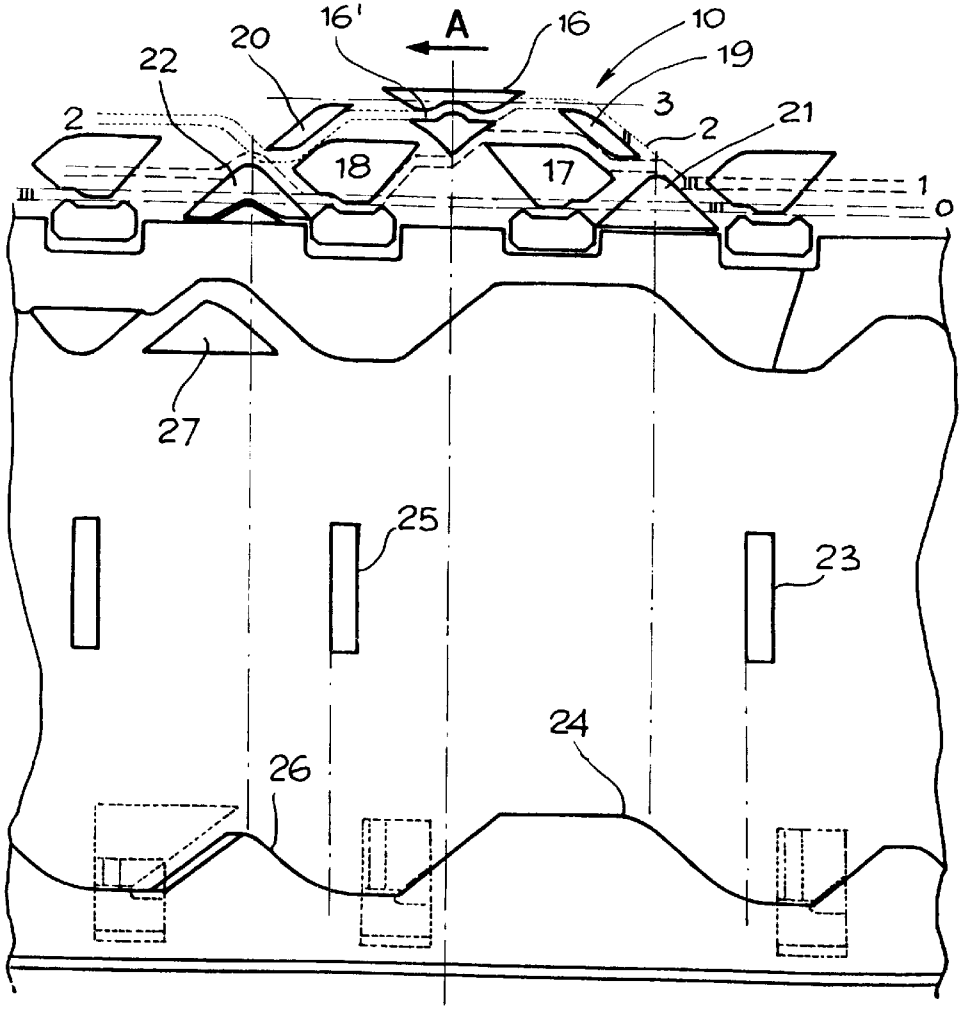
FIG. 3 is part of the development of the shell of the lock around the cylinder, particularly at the level of the cams and the selection means in the feed station, or drop, for knitting with reciprocating motion during a forward, counterclockwise, stroke of the cylinder.
Figure 2:
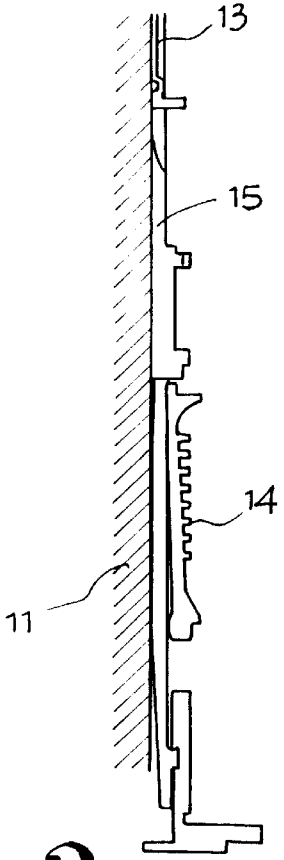
FIG. 2 is a vertical section of the cylinder with a needle, related lower needle and pusher.

In particular, looking at FIGS. 3 and 4, the following are provided for knitting with reciprocating rotating motion corresponding to the feed station or drop 10: a central cam 16 that is arranged above and in an intermediate position between a right knitting cam 17 and a left knitting cam 18; a right lateral needle ascent/descent cam 19 and a left lateral needle ascent/descent cam 20, which are arranged on opposite parts or sides of the knitting cams 17, 18 and in a higher position than same, but in a lower position compared with the central cam 16; a right ascent cam 21 and a left ascent cam 22, which are arranged on opposite parts or sides of the knitting cams in a lower position compared with same and compared with the lateral ascent/descent cams 19, 20, respectively.

All the cams 16–22 are intended to interact with the needles having a long bottom part 13, which participate with reciprocating motion in the working of knitted parts. Moreover, the ascent cams 21, 22 are those (or may be inserted only partially) that intercept and control the ascent of only the needles having a long bottom part, without, however, interfering with the needles with a short bottom part 12, which are inactive during the knitting with reciprocating motion and are kept in a completely lowered position.

The central cam 16 may be formed by two elements that are superimposed and spaced apart to define a track 16' between them. The lateral cams 19, 20 act as cams for ascending and descending needles alternately according to the direction of rotation of the cylinder. Thus, during the forward or counterclockwise stroke A, the right cam 19 causes the ascent of the needles 13 that it meets, while the left cam 20 brings about the descent of the needles that it meets and vice versa during the return or clockwise stroke R. The lateral cams 19, 20 are able to be fixed or to undergo butterfly movements in relation to the central cam 16; the latter shall thus be extended in order to lie above the lateral cams 19, 20.

For the operating selection of the needles 13, which are active during the reciprocating motion, a first selection unit 23—which is known in itself—in association with a right lower-needle ascent cam 24 and a second selection unit 25, also known, in association with a left lower needle ascent cam 26 and with a pusher ascent cam 27, with these cams 26, 27 being aligned on two levels, are provided.

The first selection unit 23 is arranged in advance compared with the feed station 10 in the direction of the forward or counterclockwise stroke A of the cylinder, and the lower-needle ascent cam 24 associated with this follows the selection unit proper.

The second selection unit 25 is arranged, always in the direction of the forward stroke, within the angle occupied by the set of cams 16–22, and more precisely, just after the left knitting cam 18; the left lower-needle ascent cam 26 and the pusher ascent cam 27 follow the second selection unit in line with or just after the left needle ascent cam 22.

It is to be noted that the same selection units, which are used in the knitting in multiple-feed and/or multiple-color machines during the continuous, counterclockwise motion, may be used as the selection units 23, 25, with the advantage of not having to resort to additional and special selection units.

Figure 5:
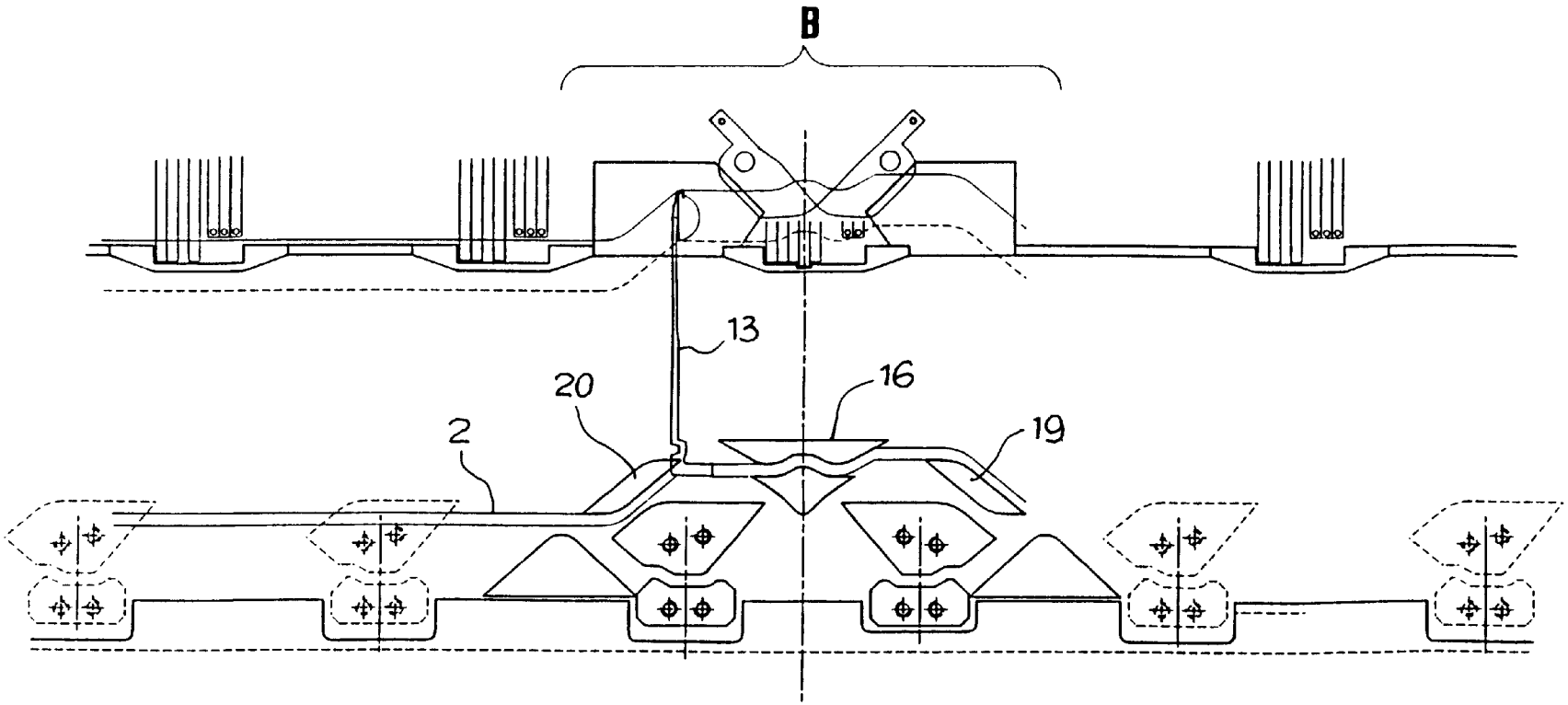
FIG. 5 is a diagram illustrating the control space of the blades of the needles.

It is to be additionally and advantageously noted that the above-mentioned arrangement makes it possible to limit even the control angle of the opening of the blades of the needles. In the case of multiple-feed machines, such control must be developed on the turn angle, while in the case of the present invention (see FIG. 5) and given the course of the needles along the path 2, it may, on the other hand, be limited substantially to only the angle B, which is defined by the ascent-descent cams 19, 20 within the limits of the knitting station 10.

In addition, in FIGS. 3 and 4:

0 denotes the course followed by the needles having a short bottom part, which always remain inactive and lowered during the knitting with reciprocating motion;

1 denotes the course of the needles having a long bottom part, which do the knitting during the forward stroke A of the reciprocating motion;

2 denotes the course of the needles having a long bottom part selected to be inactive in the forward stroke A; and

3 denotes the level at which needles having a long bottom part, which are momentarily inactive, are taken up again and made active again.

With the cams in the feed station 10 predisposed for the knitting with reciprocating motion, the needles having a short bottom part 12 are no longer intercepted by either the right 21 or left 22 needle ascent cams, and remain lowered and inactive, constantly following the inactive course 0.

On the other hand, needles having a long bottom part 13, in the forward or counterclockwise stroke A (FIG. 3), are intercepted by the right needle ascent cam 21 and are brought to the level of course 1 of the same cam. Thus, needles having a long bottom part 13 follow this course 1 less than those of them that, from time to time, are selected from the first selection unit 23. Therefore, the needles that follow the course 1 do the knitting at the level of the left knitting cam 18, ascending to the end by means of the left needle ascent cam 22. The needles selected by the first selection unit 23 are, however, lifted by the respective lower needles, which follow the right lower-needle ascent cam 24, are intercepted by the right lateral cam 19, which then acts as the ascent cam, and are led to the reuptake level 3, along the course 2 defined by this cam 19 and by the central cam 16. These needles are thus kept momentarily inactive. Then, they are forced to meet the left lateral cam 20, which then acts as the descent cam, and they are brought to the level of course 1 of the active needles beyond the left knitting cam 18.

Still during the same forward stroke A, but before initiating the return stroke R, the active needles, after the formation of the knitting at the level of the left knitting cam 18, are preselected by the second selection unit 25 to be arranged in the inactive position during the subsequent opposite stroke R. The needles thus selected are Lifted at the level of course 2 by the respective lower needles, which are intercepted by the left lower-needle ascent cam 26 and by the respective pushers, which are intercepted by the corresponding cam 27.

Thus, when the return or clockwise stroke R starts (FIG. 4), the needles that are not selected follow course 1, doing the knitting at the level of the right knitting cam 17 and ascending when they meet the right needle ascent cam 21. On the other hand, the needles selected by the second selection unit 25 are intercepted and lifted by the left lateral cam 20, which then acts as the ascent cam, at the reuptake level 3 of the needles, which are thus intercepted by the central cam, deflected below to meet the right lateral cam (which then acts as the descent cam) and shown at the level of the course 1 of the needles that were active, such that all the needles having a long bottom part are again found in the position to be selected during the subsequent forward stroke A by the first selection unit and by the second selection unit, in succession, and so on for each alternate stroke of the cylinder for removing from activity and inserting in activity some needles from opposite parts of the set of needles having a long bottom part, making the suitable decreases and increases in the stroke of the manufacture of a knitted part with reciprocating motion within the scope of a manufactured product, which may be the heel or the toe of a stocking.

Therefore, it is evident how the lateral cams 19, 20 alternately have the dual function of ascent and descent cams, and how the second selection unit 25 makes possible an anticipated selection, or a preselection of the needles, for the return stroke, with the considerable advantage of reducing the angle of rotation of the cylinder and consequently even the knitting times.

While a specific embodiment of the invention has been shown and described in detail to illustrate the application of the principles of the invention, it will be understood that the invention may be embodied otherwise without departing from such principles.

What is claimed is:

1. A circular knitting machine, comprising:

a grooved motor drive controlled cylinder, which is electronically operated to rotate with continuous rotating motion and with reciprocating motion, and to provide a signal which indicates the angular position of the cylinder;

needles having a long bottom part mounted on half of the cylinder;

needles having a short bottom part mounted on another half of the cylinder;

a plurality of lower needles are associated with each of said needles having a long bottom part and said needles having a short bottom part through an intermediate pusher;

a fixed shell having a series of cams provided around said cylinder, said cams controlling operating movements of said lower needles, said pushers and said needles having a long bottom part and said needles having a short bottom part, during the rotation of said cylinder;

a thread-feed and knitting-formation station;

selection units acting at least on said lower needles for an operating selection of said lower needles, said cams including adjacent bottom parts of said needles, a central cam, a right and left knitting cam, said central cam being arranged above and in an intermediate position between said right and left knitting cams, a right and left lateral cam for ascent and descent on opposite sides of said knitting cams, in a higher position than said knitting cams and lower than said central cam, a right needle ascent cam and a left needle ascent cam, on said opposite sides of said knitting cams, lower than said knitting cams and lower than said lateral cams, at said lower needles, at least one first selection unit of said selection units being provided with one said associated right lower-needle ascent cam and a second selection unit of said selection units being provided with one said associated left lower-needle ascent cam and a pusher ascent cam, said cams in said bottom parts of said needles being positionable to interact with said needles having a long bottom part, which do participate in the knitting with reciprocating motion, while said needles having a short bottom part are kept inactive following a low course, said first selection unit being arranged, in a direction of a forward stroke (A) of said cylinder, in front of said feed station in order to select said needles having a long bottom part which during said forward stroke (A) of said cylinder must be inactive and must follow a course of temporary exclusion from activity, while said needles having a long bottom part that are not selected follow a course of activity and knitting formation, said second selection unit being arranged adjacent to said feed station in order to carry out, during the same forward stroke and after the formation of the knitting, a preselection of said needles, which follow said course of activity and which must be excluded from activity following the course of temporary exclusion during a return stroke (R) of said cylinder, during said forward stroke (A) of said cylinder, said right and left lateral cams act as ascent and descent cams of said needles having a long bottom part, respectively, and define, together with said central cam, a course of momentary inactivity of said needles selected by said first selection unit, while, during said return stroke (R) of said cylinder, said left lateral cam acts as an ascent cam and said right lateral cam acts as a descent cam of the needles having a long bottom part, defining, together with said central cam, the course of momentary inactivity of the needles preselected by said second selection unit.

2. The circular machine in accordance with claim 1, wherein said lateral cams act as needle ascent and descent cams alternately depending on a direction of rotation of said cylinder, one of said right and left lateral cams acting as an ascent cam when the other acts as the descent cam and vice versa.

3. The circular machine in accordance with the claim 1, wherein said central cam is formed by two superimposed parts, said parts being spaced apart from one another and delimit between them a track for said needles that follow the course of inactivity, and in which said lateral cams are fixed with respect to said central cam.

4. The circular machine in accordance with the claim 1, wherein said central cam is formed by at least one piece, said one piece extends above said lateral cams, said lateral cams are mounted to be movable with respect to said central cam.

5. The circular machine in accordance with claim 1, wherein said selection units, for selecting needles for knitting with reciprocating motion, are the same as those used in the selection of needles during the knitting with continuous motion.

6. The circular machine in accordance with claim 5, wherein the selection of needles for knitting with reciprocating motion is carried out unidirectionally during a same forward stroke of said cylinder.

7. A circular knitting machine, comprising:

a grooved motor drive controlled cylinder, which is electronically operated to rotate with continuous rotating motion and with reciprocating motion, and to provide a signal which indicates the angular position of the cylinder;

needles having a long bottom part mounted on one portion of the cylinder;

needles having a short bottom part mounted on another portion of the cylinder;

a plurality of lower needles wherein each of said lower needles are associated with each of said needles having a long bottom part and said needles having a short bottom part through an intermediate pusher;

a fixed shell having a series of cams provided around said cylinder, said cams for controlling the operating movements of said lower needles, said pushers and said needles having a long bottom part and said needles having a short bottom part, during the rotation of said cylinder;

a thread-feed and knitting-formation station;

selection units acting at least on said lower needles for an operating selection of said lower needles, said cams including adjacent bottom parts of said needles, a central cam, a right and left knitting cam, said central cam being arranged above and in an intermediate position between said right and left knitting cams, a right and left lateral cam for ascent and descent on opposite sides of said knitting cams, in a higher position than said knitting cams and lower than said central cam, a right needle ascent cam and a left needle ascent cam, on said opposite sides of said knitting cams, lower than said knitting cams and lower than said lateral cams, at said lower needles, at least one first selection unit of said selection units being provided with one said associated right lower-needle ascent cam and a second selection unit of said selection units being provided with one said associated left lower-needle ascent cam and a pusher ascent cam, said cams in said bottom parts of said needles being positionable to interact with said needles having a long bottom part, which do participate in the knitting with reciprocating motion, while said needles having a short bottom part are kept inactive following a low course, said first selection unit being arranged, in a first direction of rotation (A) of said cylinder, in front of said feed station in order to select said needles having a long bottom part which during said first direction of rotation (A) of said cylinder must be inactive and must follow a course of temporary exclusion from activity, while said needles having a long bottom part that are not selected follow a course of activity and knitting formation, said second selection unit being arranged adjacent to said feed station in order to carry out, during said first direction of rotation and after the formation of the knitting, a preselection of said needles, which follow said course of activity and which must be excluded from activity following the course of temporary exclusion during a second direction of rotation (R) of said cylinder, during said first direction of rotation (A) of said cylinder, said right and left lateral cams act as ascent and descent cams of said needles having a long bottom part, respectively, and define, together with said central cam, a course of momentary inactivity of said needles selected by said first selection unit, while, during said second direction of rotation (R) of said cylinder, said left lateral cam acts as an ascent cam and said right lateral cam acts as a descent cam of the needles having a long bottom part, defining, together with said central cam, the course of momentary inactivity of the needles preselected by said second selection unit.

8. The circular machine in accordance with claim 7, wherein said lateral cams act as needle ascent and descent cams alternately depending on a direction of rotation of said cylinder, one of said right and left lateral cams acting as an ascent cam when the other acts as the descent cam and vice versa.

9. The circular machine in accordance with the claim 7, wherein said central cam is formed by two superimposed parts, said parts being spaced apart from one another and delimit between them a track for said needles that follow the course of inactivity, and in which said lateral cams are fixed with respect to said central cam.

10. The circular machine in accordance with the claim 7, wherein said central cam is formed by at least one piece, said one piece extends above said lateral cams, said lateral cams are mounted to be movable with respect to said central cam.

11. The circular machine in accordance with claim 7, wherein said selection units, for selecting needles for knitting with reciprocating motion, are the same as those used in the selection of needles during the knitting with continuous motion.

12. The circular machine in accordance with claim 7, wherein the selection of needles for knitting with reciprocating motion is carried out unidirectionally during a same first direction of rotation of said cylinder.

* * * * *